US009898921B2

(12) United States Patent
Shapiro et al.

(10) Patent No.: US 9,898,921 B2
(45) Date of Patent: Feb. 20, 2018

(54) SECURITY SYSTEM INSTALLATION

(71) Applicant: ADT US HOLDINGS, INC., Boca Raton, FL (US)

(72) Inventors: Steven Shapiro, Lake Worth, FL (US); Raymond North, Boca Raton, FL (US); Timothy Albert Rader, Lake Worth, FL (US); Jorge Perdomo, Boca Raton, FL (US); Anne-Marie Rouse, Wellington, FL (US); James Timothy Black, Delray Beach, FL (US)

(73) Assignee: ADT US Holdings, Inc., Boca Raton, FL (US)

( * ) Notice: Subject to any disclaimer, the term of this patent is extended or adjusted under 35 U.S.C. 154(b) by 159 days.

(21) Appl. No.: 14/210,877

(22) Filed: Mar. 14, 2014

(65) Prior Publication Data

US 2014/0266679 A1 Sep. 18, 2014

Related U.S. Application Data

(60) Provisional application No. 61/793,237, filed on Mar. 15, 2013.

(51) Int. Cl.

| | |
|---|---|
| ***G08B 29/00*** | (2006.01) |
| ***G08B 29/12*** | (2006.01) |
| ***G08B 21/02*** | (2006.01) |

(52) U.S. Cl.

CPC ..... *G08B 29/12* (2013.01); *G08B 21/02* (2013.01)

(58) Field of Classification Search

CPC ..... G05B 2219/2642; G08B 25/00; G08B 27/001; G08B 13/19693; G08B 21/02; G08B 29/12; H04L 12/2818; H04L 67/025

(Continued)

(56) References Cited

U.S. PATENT DOCUMENTS 5,943,673 A 8/1999 Felouzis et al.
6,335,976 B1 * 1/2002 Belmares ..... G08B 13/19602 348/155

(Continued)

FOREIGN PATENT DOCUMENTS

WO 03030550 A1 4/2003

OTHER PUBLICATIONS

International Search Report and Written Opinion dated Jul. 2, 2014 for International Application Serial No. PCT/US2014/027393, International Filing Date: Mar. 14, 2014, consisting of 17 pages.

(Continued)

*Primary Examiner* — Naomi Small
(74) *Attorney, Agent, or Firm* — Christopher & Weisberg, P.A.

(57) ABSTRACT

An apparatus, method and system for installation and testing of a system at a premises is provided. The apparatus is configured to communicate with an installer interface device. The apparatus includes a communication subsystem that provides at least one communication protocol. The communication subsystem is configured to receive data from the installer interface device and communicate with a plurality of premises devices. The apparatus includes a processor in communication with the communication subsystem. The processor is configured to automatically configure at least one life safety feature of the system at a premises. The automatic configuration includes at least configuring a plurality of premises devices based at least in part on the received data. The process is configured to test the configuration of at least one of the plurality of premises devices.

24 Claims, 10 Drawing Sheets

(58) Field of Classification Search
USPC ..... 340/516
See application file for complete search history.

(56) References Cited

U.S. PATENT DOCUMENTS

| | | | | |
|---|---|---|---|---|
| 6,680,746 | B2 | 1/2004 | Kawai et al. | |
| 6,861,951 | B2 | 3/2005 | Reghetti et al. | |
| 7,378,942 | B2 | 5/2008 | Seeley et al. | |
| 8,482,609 | B1 | 7/2013 | Mishra et al. | |
| 8,773,254 | B2 * | 7/2014 | Piccolo, III | G08B 25/14 340/501 |
| 8,817,102 | B2 | 8/2014 | Saeki et al. | |
| 8,934,017 | B2 | 1/2015 | Chen et al. | |
| 2002/0035408 | A1 | 3/2002 | Smith | |
| 2005/0071136 | A1 | 3/2005 | Vredenburgh et al. | |
| 2005/0193389 | A1 * | 9/2005 | Murphy | G06F 8/61 717/175 |
| 2006/0190228 | A1 | 8/2006 | Johnson | |
| 2008/0062167 | A1 | 3/2008 | Boggs et al. | |
| 2008/0094204 | A1 * | 4/2008 | Kogan | G08B 25/003 340/506 |
| 2008/0221714 | A1 * | 9/2008 | Schoettle | H04L 12/2829 700/90 |
| 2009/0069642 | A1 | 3/2009 | Gao et al. | |
| 2009/0074184 | A1 * | 3/2009 | Baum | G06F 17/30017 380/205 |
| 2010/0277300 | A1 | 11/2010 | Cohn et al. | |
| 2011/0251807 | A1 * | 10/2011 | Rada | G01D 4/00 702/61 |
| 2012/0078833 | A1 | 3/2012 | Johnson | |
| 2013/0010120 | A1 * | 1/2013 | Nnoruka | H04N 7/186 348/155 |
| 2013/0249410 | A1 * | 9/2013 | Thompson | H05B 37/0227 315/158 |

OTHER PUBLICATIONS

Office Action dated Aug. 9, 2016, U.S. Appl. No. 14/213,892, filed Mar. 14, 2014, consisting of 39 pages.

* cited by examiner

SECURITY SYSTEM INSTALLATION

CROSS-REFERENCE TO RELATED APPLICATION

This application is related to and claims priority to U.S. Provisional Patent Application Ser. No. 61/793,237, filed Mar. 15, 2013, entitled "SECURITY SYSTEM INSTALLATION", the entirety of which is incorporated herein by reference.

FIELD OF THE INVENTION

The invention relates to premises-based systems that centrally control a plurality of separate devices, and in particular to the installation and configuration of security and automation systems.

BACKGROUND OF THE INVENTION

The demand for systems that use a variety of devices at a location to monitor a variety of conditions, such as monitoring homes and businesses for alarm conditions, allowing users to centrally control various devices (such as thermostats, switches, cameras, appliances, etc.), monitoring medical conditions, and the like has continued to grow as more home and business owners seek better control over their premises and to protect it from various hazards and threats. Such hazards and threats include intrusion, fire, carbon monoxide and flooding, among others dangers that may be monitored and reported to a monitoring station.

Conventional systems typically employ a control panel and/or gateway that receive "event" (such as triggering alarms) and other information from various sensors and devices, and are used to operate those devices. This may be done locally by the user, or remotely through a monitoring center via a plain old telephone service (POTS) line, digital subscriber line (DSL), IP broadband connections, or cellular radio. In the case of certain alarm events, the monitoring center may also take appropriate action, such as notifying emergency responders. Installation and servicing complexity associated with these systems tends to be high as an installer has to physically mount the control panel onto the wall and manually configure the various sensors. In particular, the installer has to spend lots of time manually programing and configuring the control panel and each sensor in the system, thereby slowing down the installation process and limiting the number of security systems the installer can install in a given time period.

This is true as well for more recent all-in-one (AIO) security systems, in which the control panel and a user interface (such as a keypad) are combined in a single unit. Installation of the AIO security system requires an installer to manually program and configure the single unit and each sensor in the system. While the installer saves time by not having to install, i.e., mount, the control panel, the installer is still required to individually program and configure the control panel and multiple sensors in the security system, which is s time consuming process.

SUMMARY OF THE INVENTION

The invention advantageously provides a method and system for configuration and installation of a premises based system, such as those used for security and automation.

According to one embodiment, an apparatus for installation and testing of a system at a premises is provided. The apparatus is configured to communicate with an installer interface device. The apparatus includes a communication subsystem that provides at least one communication protocol. The communication subsystem is configured to receive data from the installer interface device and communicate with a plurality of premises devices. The apparatus includes a processor in communication with the communication subsystem. The processor is configured to automatically configure at least one life safety feature of the system at a premises. The automatic configuration includes at least configuring a plurality of premises devices based at least in part on the received data. The processor is configured to test the configuration of at least one of the plurality of premises devices.

According to one embodiment of this aspect, the communication subsystem is further configured to receive an indication from the installer interface device to configure at least one additional premises device. The processor is further configured to configure the at least one additional premises device based at least in part on the indication from the installer interface device. According to another embodiment of this aspect, life safety is associated with a medical condition. According to another embodiment of this aspect, the data includes at least one of system parameters, device count, communications configuration, device type and device location within a premises layout mapping.

According to another embodiment of this aspect, the communication subsystem is further configured to receive preconfigured system data before the receipt of the data from the installer interface device. The automatic configuration of the at least one life safety feature of the system being based at least in part on the received preconfigured system data. According to another embodiment of this aspect, the modification of the system includes at least one of adding a premises device, removing a premises device, modifying premises device settings and upgrading firmware. According to another embodiment of this aspect, the testing includes at least one of determining whether a received signal of the at least one premises device falls within a predefined parameter range and determining whether at least one event signal from at least one life safety premises device is received.

According to another embodiment of this aspect, the plurality of premises devices includes at least one life safety device and lifestyle device. The automatic configuration includes automatically configuring at least one life style feature of the system at a premises. The automatic configuration includes at least configuring at least one of the plurality of premises devices based at least in part on the received data.

According to another embodiment, a method for installation and testing of a system at a premises is provided. The system includes a plurality of premises devices. Data is received from an installer interface device. The plurality of premises devices are communicated with. At least one life safety feature of the security system is automatically configured. The automatic configuration includes at least configuring the plurality of premises devices based at least in part on the received data. The configuration of at least one of the plurality of premises devices is tested.

According to one embodiment of this aspect, receiving an indication is received from the installer interface device to configure at least one additional premises device. The at least one additional premises device is configured based at least in part on the indication from the installer interface device. According to one embodiment of this aspect, the automatic configuration includes automatically configuring at least one life style feature of the system at a premises. The automatic configuration includes at least configuring at least one of the plurality of premises devices based at least in part on the received data. According to one embodiment of this aspect, the data includes at least one of system parameters, device count, communications configuration, device type and device location within a premises layout mapping. According to one embodiment of this aspect, preconfigured system data for configuring at least one premises device is received before receipt of the data from the installer interface device. The automatic configuration of the security system is based at least in part on the received preconfigured system data. According to one embodiment of this aspect, modification of the system includes at least one of adding a premises device, removing a premises device, modifying premises device settings and upgrading firmware. According to one embodiment of this aspect, the testing includes at least one of determining whether a received signal strength at the at least one premises device falls within a predefined parameter range and determining whether at least one event signal from at least one life safety premises device is received. According to one embodiment of this aspect, the plurality of premises devices includes at least one life safety device and lifestyle device. The life safety device is configured to detect a medical emergency at the premises.

According to another embodiment, a system for configuration and testing of an arrangement at a premises is provided. The arrangement includes a plurality of premises devices. The system includes an installer interface device. The installer interface device includes a first processor configured to download system data that includes configuration data for configuring the plurality of premises devices. The processor is configured to prompt a user of the installer interface device to verify the system data. The processor is configured to, if the system data is verified by the user of the installer interface device, transmit the system data. The system includes a control unit. The control unit includes a communication subsystem that provides a plurality of communication protocols. The communication subsystem is configured to receive the system data from the installer interface device and communicate with a plurality of premises devices. The control unit includes a second processor configured to automatically configure at least one life safety feature of the system at a premises. The automatic configuration includes at least configuring a plurality of premises devices based at least in part on the received system data. The second processor is configured to test the configuration of at least one of the plurality of premises devices.

According to one embodiment of this aspect, the communication subsystem of the control unit is further configured to receive an indication from the installer interface device to configure at least one additional premises device. The second processor is further configured to configure the at least one additional premises device based at least in part on the indication from the installer interface device. According to one embodiment of this aspect, the second processor is further configured to authenticate the installer interface device before automatically configuring the plurality of premises devices. According to one embodiment of this aspect, the system data includes at least one of system parameters, device count, communications configuration, device type and device location within a security system layout mapping. According to one embodiment of this aspect, the communication subsystem is further configured receive preconfigured system data before the receipt of system data from the installer interface device. The automatic configuration of the security system is based at least in part on the received preconfigured system data.

According to one embodiment of this aspect, modification of the system includes at least one of adding a premises device, removing a premises device, modifying premises device settings and upgrading firmware. According to one embodiment of this aspect, the testing includes at least one of determining whether a received signal strength at the at least one premises device falls within a predefined parameter range and determining whether at least one event signal from at least one life safety premises device is received. According to one embodiment of this aspect, the plurality of premises devices includes at least one life safety device and lifestyle device.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
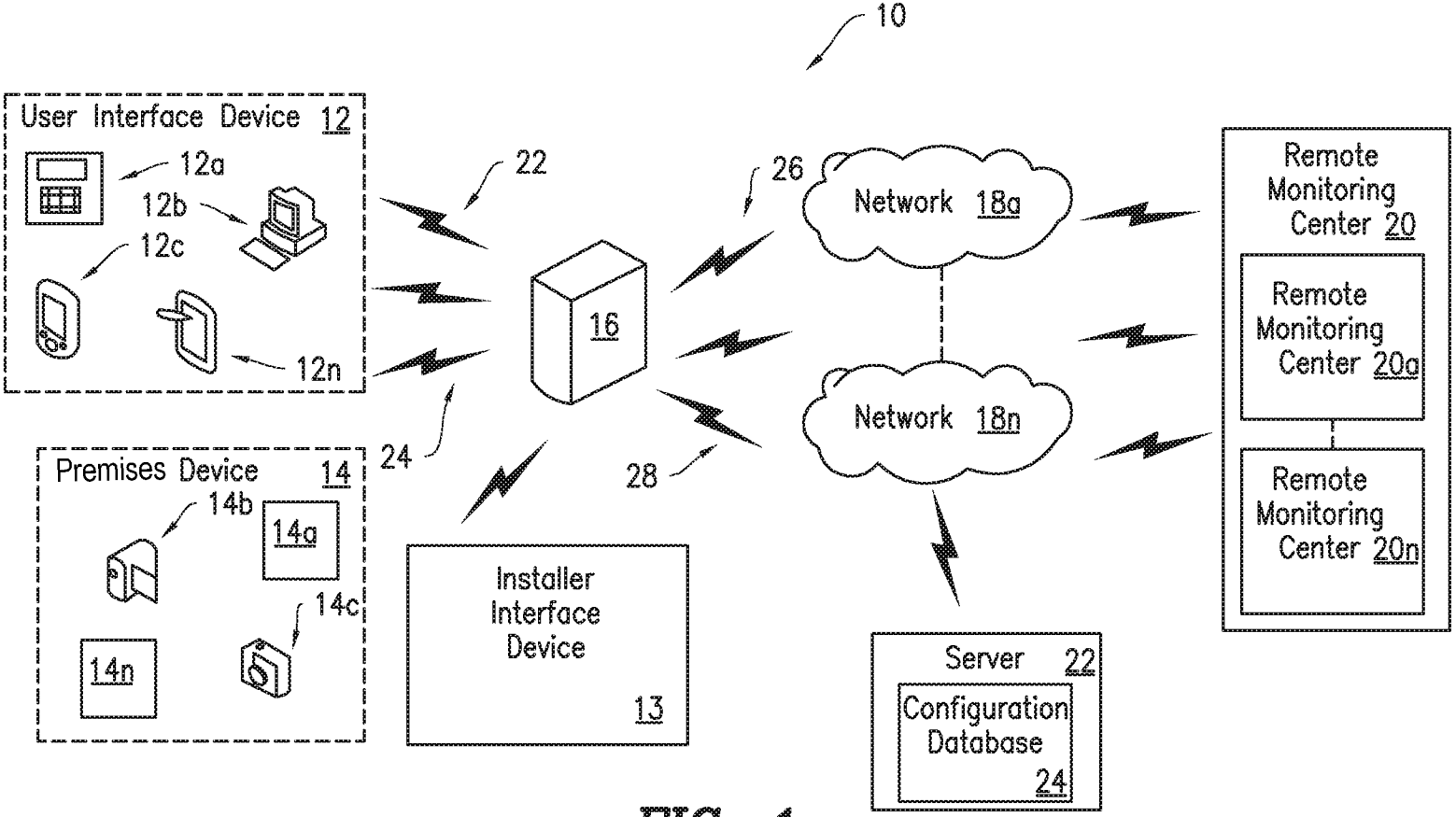
FIG. 1 is a block diagram of a security control system for security control management, constructed in accordance with the principles of the invention.

The invention advantageously provides a system, device and method for configuration and installation of a premises based system. Accordingly, the system, device and method components have been represented where appropriate by convention symbols in the drawings, showing only those specific details that are pertinent to understanding the embodiments of the invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Referring now to the drawing figures in which like reference designators refer to like elements there is shown in FIG. 1 a control system constructed in accordance with the principles of the invention and designated generally as "10." System 10 may include one or more user interface devices 12*a* to 12*n* (collectively referred to as "user interface device 12"), one or more installer interface devices 13, one or more premises devices 14*a* to 14*n* (collectively referred to as "premises device 14"), control unit 16, one or more networks 18*a* to 18*n* (collectively referred to as "network 18") and one or more remote monitoring centers 20*a* to 20*n* (collectively referred to as "remote monitoring center 20"), one or more remote servers 22, communicating with each other. The components being installed at a premises to be monitored include one or more user interfaces devices 12, one or more premises devices 14 and control unit 16. In one embodiment, the remote servers 22 are installed at a remote monitoring center 20 or distributed among multiple remote monitoring centers 20.

User interface device 12 may be a wireless device that allows a user to communicate with control unit 16. User interface device 12 may be a portable control keypad/interface 12*a*, computer 12*b*, mobile phone 12*c* and tablet 12*n*, among other devices that allow a user to interface with control unit 16. User interface device 12 may communicate at least with control unit 16 using one or more wireless communication protocols well known to those of ordinary skill in the art. For example, portable control keypad 12*a* may communicate with control unit 16 via a ZigBee based communication link 22, e.g., network based on Institute of Electrical and Electronics Engineers (IEEE) 802.15.4 protocols, and/or Z-wave based communication link 24, or over the premises' local area network, e.g., network based on Institute of Electrical and Electronics Engineers (IEEE) 802.11 protocols. Other communication protocols may be used and may be directional or bi-directional, and proprietary and not per any published standard. User interface device 12 is discussed in detail with respect to FIG. 3. Installer interface device 13 is similar to user interface device 12 with functionality varying as described herein with respect to FIGS. 7 and 8. For example, installer interface device 13 may be a computer, tablet or laptop device that is configured to run a management application or tool for configuring system 10.

Premises devices 14 may include one or more types of sensors, control and/or image capture devices. For example, the types of sensors may include various life safety related sensors such as motion sensors, fire sensors, carbon monoxide sensors, flooding sensors, medical emergency/condition sensors and contact sensors, among other sensor types that are known in the art. Life safety may be associated with medical conditions and/or emergencies. The control devices may include, for example, one or more life style related devices configured to adjust at least one premises setting such as lighting, temperature, energy usage, door lock and power settings, among other settings associated with the premises or devices on the premises. Image capture devices may include a digital camera and/or video camera, among other image captures devices that are well known in the art. Premises device 14 may communicate with control unit 16 via proprietary wireless communication protocols, standard wireless communication protocols and/or may also use Wi-Fi, both of which are known in the art. Those of ordinary skill in the art will also appreciate that various additional sensors and control and/or image capture devices may relate to life safety or life style depending on both what the sensors, control and image capture devices do and how these sensors, control and image devices are used by system 10. Premises devices 14 may communicate life safety and/or life style data to control unit 16. One of the advantages of the invention is the ability to use any of these devices irrespective of whether they are life safety or life style.

Control unit 16 may provide management functions such as power management, premises device management and alarm management, premises device 14 configuration, among other functions. Control unit 16 may be a security control unit. In particular, control unit 16 may manage one or more life safety and life style features. Life safety features may correspond to security system functions and settings associated with premises conditions that may result in life threatening harm to a person such as carbon monoxide detection and intrusion detection. Life style features may correspond to security system functions and settings associated with video capturing devices and non-life threatening conditions of the premises such as lighting and thermostat functions. Example control unit 16 components and functions are described detail with respect to FIG. 2.

Control unit 16 may communicate with network 18 via one or more communication links. In particular, the communications links may be broadband communication links such as a wired cable modem or Ethernet communication link 26, and digital cellular communication link 28, e.g., long term evolution (LTE) based link, among other broadband communication links known in the art. Broadband as used herein may refer to a communication link other than a plain old telephone service (POTS) line, and may be wired and/or wireless. Ethernet communication link 26 may be an IEEE 802.3 based communication link. Network 18 may be a wide area network, local area network, wireless local network and metropolitan area network, among other networks known in the art. Network 18 provides communications between control unit 16, remote monitoring center 20 and/or remote server 22, discussed below.

System 10 may include remote monitoring center 20 that is capable of performing monitoring, configuration and/or control functions associated with control unit 16. For example, remote monitoring center 20 may include a remote life safety monitoring center that monitors life safety features associated with control unit 16 in which the remote monitoring center 20 receives life safety data from control unit 16. For example, with respect to fire and carbon monoxide detectors/sensors, life safety data may include at least one carbon monoxide readings, smoke detection reading, sensor location and time of reading, among other related to these detectors that may be communicated with remote monitoring center 20. In yet another example, with respect to a door contact detector, life safety data may include at least one of sensor location and time of detection, among other data related to the door contact detection that may be communicated with remote monitoring center 20.

Alarm event data from the premises may be used by the remote monitoring center in running through various life safety response processes in notifying the owner of the premises, determining whether an actual alarm event is occurring at the premises, and notifying any appropriate response agency (e.g., police, fire, emergency response, other interested parties such as premises owners, etc.).

The same or separate remote monitoring center 20 may also include a life style system/service that allows for various life style features associated with security control 16. The remote life style system may receive life style data from control unit 16. For example, with respect to temperature control, life safety data may include thermostat readings. In yet another example, with respect to video capture devices, life style data may include at least one of captured images, video, time of video capture and video location, among other data related to video capture devices that may be communicate with remote monitoring center 20. Remote monitoring center 20 and/or remote server 22 may provide updates to control unit 16 such as updates to features associated with life safety and/or life style operating system. Those of ordinary skill in the art will appreciate that video and other data may also be used by the life safety monitoring center. Remote server 22 is in communication with at least one of installer interface device 13, control unit 16, network 18 and remote monitoring center 20. Remote server 22 may include configuration database 24 that stores configuration data for configuring at least one of user interface device 12, premises device 14 and control unit 16. Remote server 22 may send and receive the configuration data to/from configuration database 24 via a communication interface. Remote server 22 also includes memory and one or more processors forming the configuration database.

Figure 2:
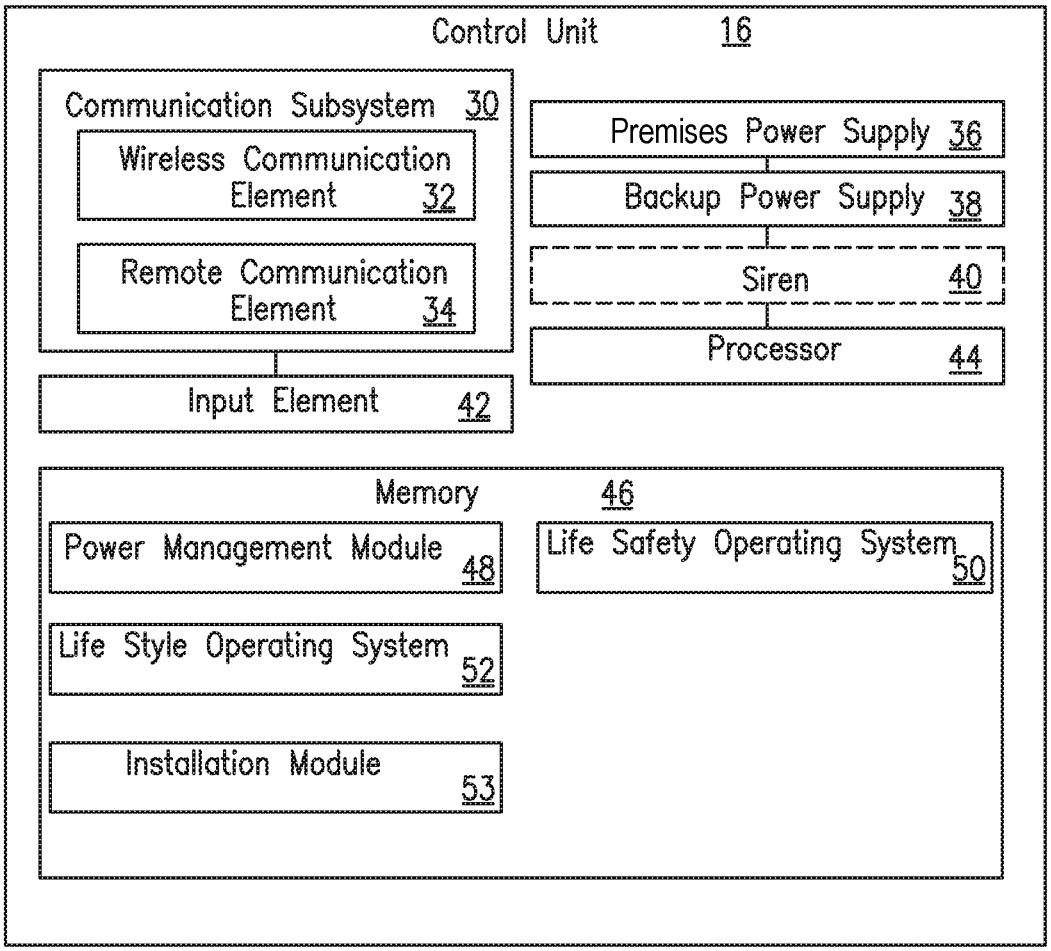
FIG. 2 is a block diagram of a security control unit constructed in accordance with the principles of the invention.

An example control unit 16 for managing a premises-based system is described with reference to FIG. 2. Control unit 16 may include communication subsystem 30 that is configured to provide communications with user interface device 12, premises device 14, network 18, remote monitoring center 20 and/or remote server 22, i.e., communication subsystem 30 provides at least one communication protocol. In particular, communication subsystem 30 may include wireless communication element 32 and remote communication element 34. Wireless communication element 32 provides wireless communication with user interface device 12 and premises device 14. Wireless communication element 32 may support one or more wireless communication protocols such as ZigBee, Z-wave and Wi-Fi, e.g., IEEE 802.11, among others wireless communications protocols that support wireless data transfer.

Wireless communication element 32 may be composed of one or more hardware components in which each hardware component is configured to provide wireless communication using a specific protocol. For example, wireless communication element 32 may include a ZigBee hardware component configured to provide ZigBee based communications and a Z-wave hardware component configured to provide Z-wave based communications. Wireless communication element 32 may provide other wireless communication protocols. The hardware components associated with wireless communication element 32 may be internal components within control unit 16 such that these features are built-in or standard features. Alternatively, any one or more of the hardware components associated with wireless communication element 32 may be external components that may be replaced by a user, homeowner or installer. For example, the ZigBee and Z-wave hardware component modules may be internal components while the Wi-Fi hardware component may be an external component that allows for upgrading and/or an internal component. Wireless communication element 32 may broadcast a wireless signal so that user interface device 12 may connect directly to control unit 16. For example, wireless communication element 32 may provide a Wi-Fi encrypted service set identifier (SSID) and path for communication with multiple user interface devices 12.

By supporting a plurality of wireless communication protocols, wireless communication element 32 enables control unit 16 to be used with a variety of user interface devices 12 and premises devices 12 that are designed to work using only a specific wireless communication protocol. Supporting a plurality of wireless communication protocols allows easy upgrading of existing user interface device 12 and premises device 14, and for control unit 16 integration with various equipment venders that may incorporate different wireless protocols. Wireless communication element 32 may provide two-way voice communication with user interface device 12, which is then communicated with remote monitoring center 20. For example, wireless communication element 32 may support voice over internet protocol (VoIP) based communications. In one embodiment, component parts of wireless communication element 32, e.g., an IEEE 802.11 communication module, may also be past of remote communication element so that the wireless communication protocols, e.g., IEEE 802.11 protocols, can be used to communicate with remote monitoring center 20. In other words, one or more specific communication modules of wireless communication element 32 can also be part of remote communication element 34.

Remote communication element 34 is configured to provide broadband communications with remote monitoring center 20 via network 18. For example, remote communication element 34 may be an Ethernet based hardware component that provides communication with network 18. Alternatively or in addition to Ethernet based hardware component, remote communication element 34 may include a Wi-Fi (IEEE 802.11) hardware component that provides communication with a home or other premises network, e.g., a home wireless network, and may utilize some of the same components as wireless communication element 32. The remote communication element 34 may also include a cellular radio hardware component that provides communications with at least one cellular network such as an LTE based cellular network. Control unit 16 may use Ethernet communication link 26 as a primary communication link such that the cellular communication link is used for broadband communications when the Ethernet or primary communication link is not functioning properly such as during a power outage where a home network is unavailable, i.e., home network router has no power.

Control unit 16 may include premises power supply 36 that is configured to provide power to control unit 16. For example, premises power supply 36 may provide power to control unit 16 via a home alternating current (AC) power outlet or other power outlets that are known in the art. Premises power supply 36 may be a primary power supply such that control unit 16 operates using power from the premises power supply 36 when available. Control unit 16 may also include back-up power supply 38 that provides power during premises power supply failure. Back-up power supply 38 may include one or more disposable or rechargeable batteries that are configured to provide enough power to operate control unit 16 for first predetermined amount of time and activate siren 40 for a second predetermined amount of time, e.g., a user can access the security system for at least twenty-four hours while control unit 16 is power by back-up power supply 38 while the siren can be activated and operate after the twenty-four hour period.

Siren 40 may be an eighty-five decibel (dB) siren, among other audible devices known in the art. Siren 40 may be an optional component in control unit 16 such that audible alerts are generated by user interface device 12, e.g., portable control keypad/interface 12*a*, and not control unit 16. Moreover, control unit 16 may include at least one universal serial bus port (USB) to receive power from a laptop or other device with a USB interface. Other port types capable of providing power to control unit 16 may be used based on design need.

Input element 42 may be configured to receive input data from a user. For example, input element 42 may be a ten number keypad that enables a user to arm and disarm system 10. Input element 42 allows for an alternative or back-up way of arming and disarming system when no user interface device 12 is available to a user. Other input elements may be used as are known in the art. Control unit 16 may include one or more indicators such as light emitting diodes (LEDs) that may indicate the status of control unit 16. For example, a first LED is turned on when security control panel is powered, a second LED is turned on when the system is armed or disarmed, a third LED is turned on when an internet protocol connection is connected, a fourth LED may be turned on when the cellular connection has sufficient strength and the first LED may flash during low power conditions, among other LED and LED on/off may be used based on design need. Processor 44 may be a central processing unit (CPU) that executes computer program instructions stored in memory 46 to perform the functions described herein.

Memory 46 may include non-volatile and volatile memory. For example, non-volatile memory may include a hard drive, memory stick, flash memory and the like. Also, volatile memory may include random access memory and others known in the art. Memory 46 may store power management module 48, life safety operating system 50 and life style operating system 52, among other data and/or modules. Power management module 48 includes instructions, which when executed by processor 44, causes processor 44 to perform the process described herein, such as the power management process, discussed in detail with reference to FIG. 5. Life safety operating system is configured to provide life safety features associated with system 10. Life style operating system 52 is configured to provide life style features associated with system 10. In particular, processor 44 is configured to run both life safety operating system 50 and life style operating system 52 such that separate processors are not needed to run both operating systems. This single processor configuration reduces cost while still providing both life safety and life style features.

Memory 46 includes installation module 53 for configuring system 10. Installation module 53 includes instructions, which when executed by processor 44, causes processor 44 to perform the process described herein, such as the installation process, discussed in detail with reference to FIG. 9. Memory 46 may include a Wi-Fi high-jacking module (not shown) that varies control unit 16 settings when processor determines an unauthorized device has connected to control unit 16 via Wi-Fi. For example, Wi-Fi high-jacking module may shutdown Wi-Fi and/or move to low power RF such that user interface device 12 and/or premises device 14 can still communicate with security control panel. Memory 46 may include an auto enrollment module (not shown) that is configured to cause processor 44 to search, wirelessly, for user interface device 12 and premises device 14 located within or near the premises. The auto enrollment module may cause processor 44 to forward information associated with the found devices 12 and 14 to remote monitoring center 20 such that remote monitoring center 20 may push enrollment data to control unit 16 to facilitate configuration. Control unit 16 may use the enrollment data configured the security system such that the system operates using the found devices 12 and/14. Auto enrollment module reduces installation time as the devices 12 and/14 are automatically found and enrolled for use by control unit 16.

Figure 3:
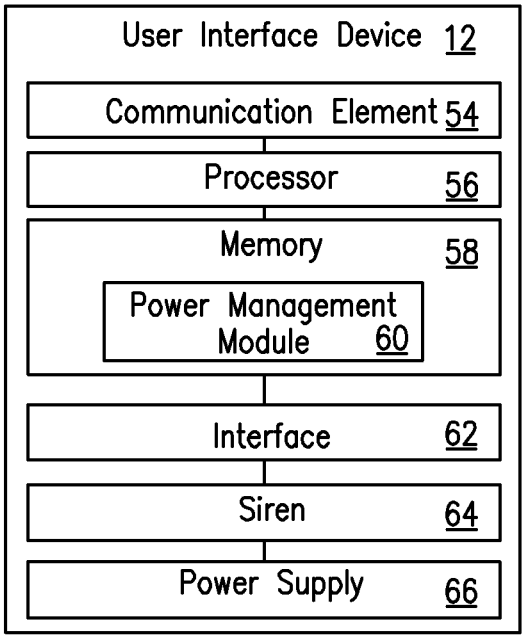
FIG. 3 is a block diagram of a user interface device constructed in accordance with the principles of the invention.

An example user interface device 12 for providing local control and configuration data is described with reference to FIG. 3. User interface device 12 may include a portable control keypad/interface 12*a*, personal computer 12*b*, mobile device 12*c* and tablet computer 12*n*, among other devices. User interface device 12 includes communication element 54 that is configured to communicate with control unit 16 via at least one wireless communication protocol such as ZigBee, Z-wave and Wi-Fi, among other protocols known in the art. User interface device 12 may include processor 56 and memory 58 that correspond to control unit 16 components, with size and performance being adjusted based on design need. Processor 56 performs the functions described herein with respect to user interface device 12.

Figure 6:
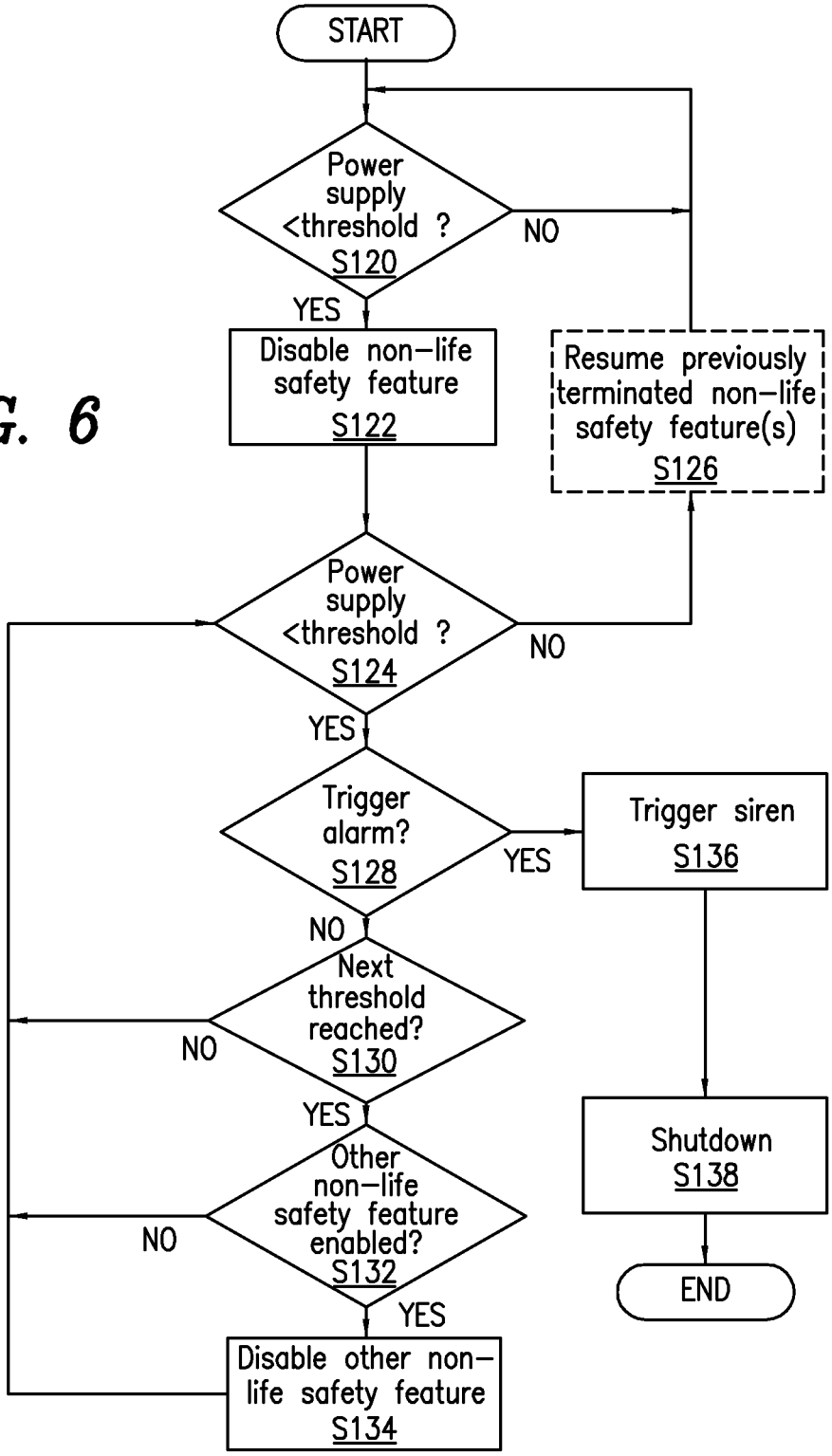
FIG. 6 is a flow chart of an example user interface device power management process of the invention, constructed in accordance with the principles of the invention.

Memory 58 may include power management module 60 in which power management module 60 includes instructions, which when executed by processor 56, causes processor 56 to perform the process described herein, such as the power management process, discussed with respect to FIG. 6. Memory 58 may store other modules and data based on design need. Interface 62 may be user interface configured to receive user inputs. For example, interface 62 may receive local control and configuration data input from user.

User interface device 12 may include siren 64 such as an eighty-five dB siren or other audible device(s) known in the art. User interface device 12 may include power supply 66 for supplying power to user interface device 12. Power supply 66 may include one or more rechargeable and/or disposable batteries, among other types of batteries that are well known in the art. Moreover, user interface device 12 may be powered via a universal serial bus (USB), have an interface that allows the connection of an external power adapter/recharger, and/or other connection type.

Figure 4:
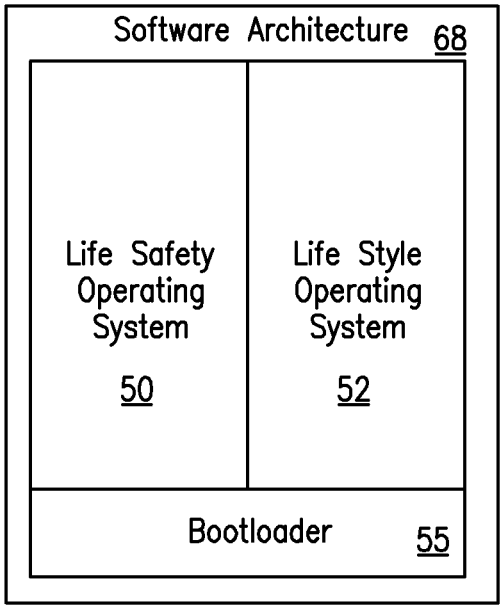
FIG. 4 is a block diagram of a software architecture of the security control unit, constructed in accordance with the principles of the invention.

Example software architecture 68 of control unit 16 is described with reference to FIG. 4. In particular, software architecture 68 may include life safety operating system 50, life style operating system 52 and bootloader 55, among other software components relates to security feature management and operation of control unit 16. Life safety operating system 50 and life style operating system 52 are configured to run in control unit 16 in which the life safety operating system 50 and life style operating system 52 run in a virtual machine configuration. The virtual machine configuration allows a single processor such as processor 44 to separately run the life safety operating system 50 while updating life style operating 52 without negatively affecting features associated with life safety operating system 50, i.e., life safety features remain functioning while life style features are updated. The converse is also contemplated. Bootloader 55 is used to load the run time environment for operating systems 50 and 52.

Figure 5:
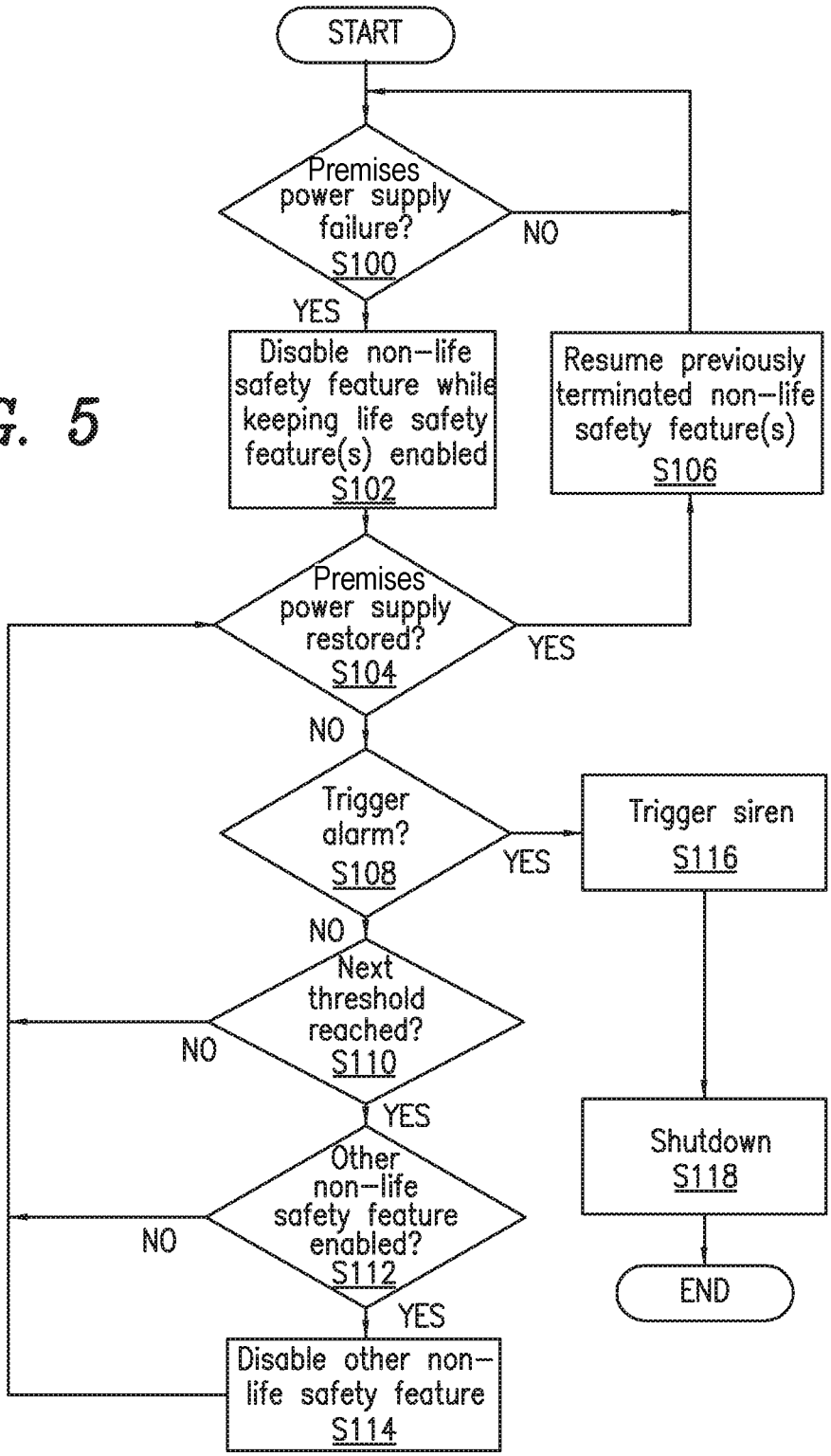
FIG. 5 is a flow chart of an example security control unit power management process of the invention, constructed in accordance with the principles of the invention.

An example power management process is illustrated in FIG. 5. The power management process relates to managing a security system based at least in part on the monitoring of premises power supply 36 and back-up power supply 38. Processor 44 determines whether premises power supply 36 has failed (Block S100). For example, processor 44 may monitor the power being provided by premises power supply 36 using well known methods in the art to determine whether power failure has occurred. Power failure may occur when the voltage being supplied by premises power supply 36 falls below a predefined voltage threshold. If processor 44 determines a power failure has not occurred, the determination of Block S100 may be repeated.

If the determination is made that premises power supply 36 is in a power failure condition, processor 44 disables a non-life safety feature such as a life style feature, while keeping the life safety feature(s) enabled (Block S102). For example, the temperature control feature associated with the life style operating system may be disabled while keeping the intrusion detection, fire detection and carbon monoxide detection features associated with life safety operating system 50 enabled. Power management module 48 advantageously allows non-life safety features such as life style features associated with life style operating system 50 to be disabled without interrupting life safety features associated with life safety operating system 52. This configuration helps ensure life safety features will remain enabled during premises power supply 36 failure while at the same time reducing power consumed by disabling a non-life style feature. For example, some life style features may require or attempt to initiate communication with user interface device 12 and/or remote monitoring center 20 in which such communications consume power, i.e., may consume limited back-up power. Other non-life style features that may be disabled include turning off any security control device LEDs and/or terminating communications to user interface device 12 while maintaining communications with premises devices. Therefore, disabling at least one non-life safety feature reduces the amount of power consumed by control unit 16 in which the more non-life safety features that are disabled, the greater the power savings.

Processor 44 determines whether premises power supply 36 has been restored based at least in part on the monitoring of premises power supply 36 (Block S104). For example, processor 44 may continually or periodically monitor the power level of premises power supply 36 to determine whether the power level is equal to or above the predetermined voltage threshold. If processor 44 determines premises power supply 36 has been restored, processor 44 may resume or enable the previously disabled non-life safety feature(s) (Block S106). In other words, the power management process enables non-life safety features such as life style features that may consume more power once security control device 16 is being power by premises power supply 36 such that the non-life safety features consume minimal power from the back-up power supply 38.

If the determination is made that power of premises power supply 36 has not been restored, a determination is made whether to trigger an alarm such as an audible alarm (Block S108). In particular, an audible alarm may be trigger after processor 44 determines control unit 16 has been operating on back-up power supply 38 for a predetermined amount of time, e.g., twenty-four hours. The predetermined amount of time may be based on design need and/or regulatory requirements. If the determination is made to trigger an alarm, siren 40 or siren 64 may be triggered for a predetermined amount of time (Block S116). In one embodiment, processor 44 uses communication subsystem 30 to send a siren trigger message to user interface device 12 to trigger siren 64 in user interface device 12. For example, siren 64 may be triggered for at least four minutes in order to alert a user of a control unit 16 status such as loss of all power. The predetermined amount of time the alarm is triggered may be based on design need and/or regulatory requirements. Other criteria may be used to trigger an audible alarm based on design need. After triggering siren 64, control unit 16 may shut down (Block S118). For example, control unit 16 may perform a graceful shutdown according to a shutdown routine when the back-up power supply 38 reaches a predefined threshold such as ten percent power remaining.

Referring back to Block S108, if processor 44 makes the determination not to trigger an alarm, processor 44 determines whether an available power threshold has been reached (Block S110). The power threshold may correspond to a back-up power supply 38 level at which another non-life safety feature may be shutdown in order to reduce power consumption. For example, a different non-life safety feature may be terminated every time the power level falls by a predetermined amount such as five or ten percent or to a predetermined level. Moreover, one or more non-life safety features may be terminated at a time. If the determination is made that the feature threshold is not reached, the determination of Block S104 may be repeated.

If the determination is made that the power threshold has been reached, processor 44 determines whether at least one other non-life safety feature, e.g., life style feature, is enabled (Block S112). For example, a lighting life style feature may have been previously been disabled in Block S102 but a temperature life style feature remains enabled. If the determination is made that at least one other non-life safety feature is not enabled, the determination of Block S104 may be repeated. If processor 44 determines at least one other non-life safety feature is enabled, processor 44 disables the at least one other non-life safety feature such that the non-life safety features consume less power from the back-up power supply 38 (Block S114). The order of which non-life safety features are disabled may vary based on design need and power consumption of individual features or other criteria. After disabling the at least one other non-life safety feature, the determination of Block S104 may be repeated. The power management process helps ensure more important or safety-dependent features stay powered by terminating or disabling less important features such as life style features. Alternatively, processor 44 may disable more than one or all non-life safety features at one time.

An example power management process for user interface device 12 is illustrated in FIG. 6. The power management process relates to managing user interface device 12 features based at least in part on the monitoring of power supply 66. For example, processor 56 may monitor the power being provided by power supply 66 using well known methods in the art. Processor 56 determines whether the power being supplied by power supply 66 drops below a predefined threshold based at least in part on the monitoring, i.e., whether a power supply 66 voltage or power level is less than a threshold (Block S120). The threshold may be a power and/or voltage level determined based on design need and/or other factors. If processor 56 determines power supply 66 is not below, i.e., greater than or equal to, a predetermined threshold, the determination of Block S120 may be repeated.

If the determination is made that the power supply 66 is below the predetermined threshold, processor 56 disables at least one non-safety feature while keeping life safety feature (s) enabled at user interface device 12 (Block S122). For example, processor 56 may disable a life style feature such that less power may be consumed by not having to perform processing, communication and/or other functions associated with the disabled feature. Other non-safety features may include a backlight keypad and/or display feature. Therefore, disabling at least one non-life safety feature reduces the amount of power consumed by user interface device 12 such that the more non-safety features that are disabled, the greater the power savings.

After at least one non-life safety has been disabled, processor 56 may determine whether power supply 66 is still below the threshold based at least in part on the monitoring (Block S124). For example, processor 56 may continually or periodically monitor the voltage level of power supply 66. If the determination is made that power supply 66 is not below the threshold (i.e., is greater than or equal to the threshold), processor 56 may resume the previously disabled or terminated non-safety feature(s) (Block S126). In other words, the power management process of FIG. 6 enables or executes the previously disabled non-life safety feature(s) that may consume more power once power supply 66 is greater than or equal to the threshold such that the non-life safety features consume minimal power from power supply 66. Power supply 66 may rise back to the predetermined threshold level when power supply 66 is being recharged and/or when user interface device 12 is being power via USB, among other situations where power supply 66 is no longer below the predetermined threshold. Alternatively, Blocks S124 and S126 may be skipped or excluded from the power management process of FIG. 6 based on design need, i.e., the process moves from Block S122 directly to Block S128.

If the determination is made that power supply 66 is below threshold, processor 56 determines whether to trigger an alarm such as an audible alarm (Block S128). In particular, an audible alarm may be trigger after processor 56 determines power supply 66 has reached a lower predetermined threshold. For example, the lower predetermined threshold may correspond to a minimum power level needed to trigger siren 64 for a predetermined amount of time and/or shutdown user interface device 12. The lower predetermined threshold may be based on design need. If the determination is made to trigger an alarm, siren 64 and/or siren 40 may be triggered for a predetermined amount of time (Block S136). For example, siren 64 may be triggered for at least four minutes in order to alert a user of user interface device 12 status such as a loss of all power status. The predetermined amount of time the alarm is triggered may be based on design need and/or regulatory requirements. Other criteria may be used to trigger an audible alarm based on design need. After triggering siren 64, user interface device 12 may shut down (Block S138). For example, control unit 16 may perform a graceful shutdown according to a shutdown routine.

Referring back to Block S128, if the determination is made not to trigger an alarm, processor 56 determines whether a feature threshold has been reached (Block S130). The feature threshold may correspond to a back-up power supply 38 level at which another feature may be shutdown in order to reduce power consumption. For example, a difference feature may be terminated every time the power level fails another predetermined amount, e.g., five or ten percent. Moreover, more than one feature may be disabled or terminated at a time. If the determination is made that the feature threshold is not reached, the determination of Step S124 may be repeated. Alternatively, if Block S124 is skipped or excluded from the process and the determination is made that the feature threshold not been reached, the determination of Block S128 may be performed.

If the determination is made that the feature threshold is reach, processor 56 determines whether at least one other non-life safety feature is enabled (Block S132). If the determination is made that at least one other non-life safety feature is not enabled, the determination of Block S124 may be repeated. Alternatively, if Block S124 is skipped or excluded from the process and the determination is made that at least one other non-life-style feature is not enabled, the determination of Block S128 may be repeated, i.e., the process moves from Block S132 to Block S128. If processor 56 determines at least one other non-life safety feature is enabled, processor 56 disables the at least one other life style feature such that the non-life safety features consume less power from power supply 66 (Block S134). The order of which non-life safety features are disabled may vary based on design need and power consumption of individual features or other criteria.

After disabling the at least one other non-life style feature, the determination of Block S124 may be repeated. Alternatively, if Block S124 is skipped or excluded from the process and the other non-life safety feature has been disabled at Block S134, the determination of Block S128 may be repeated, i.e., the process moves from Block S134 to Block S128. The power management process helps ensure more important or safety dependent features remain operating by terminating or disabling less important features such as life style features or other non-safety features at user interface device 12. Alternatively, processor 56 may disable more than one or all life style features at one time. In one embodiment, the power management is configured and power supply 66 sized such that processor 56 can still trigger and sound siren 64 for four minutes after a twenty-four hour period upon the occurrence of a triggering condition, e.g., low battery, sensor trigger detection, receipt of trigger message from control unit 16, etc.

Figure 7:
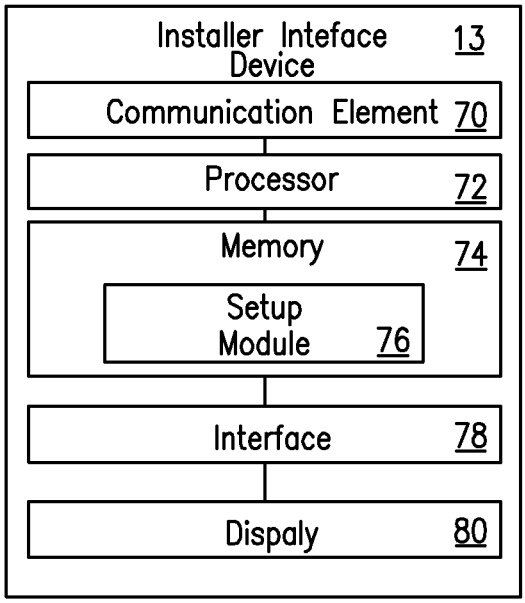
FIG. 7 is a block diagram of an example installer interface device constructed in accordance with the principles of the invention.

An example installer interface device 13 for configuring a premises based system 10 is described with reference to FIG. 7. Installer interface device 13 includes communication element 70, processor 72, memory 74 and interface 78, and substantially corresponds to like components of user interface device 12 with size and performance being adjusted based on design need. Installer interface device 13 may include display 80 for displaying security system information to the installer and/or user. Communication element 70 may communicate with user interface device 12, premises device 14, control unit 16, network 18, remote monitoring center 20 and/or remote server 22, among other networks and devices. Memory 74 may include setup module 76 for configuring control unit 16. In particular, setup module 76 includes instructions, which when executed by processor 72, causes processor 72 to perform the process described herein, such as the setup process, discussed with respect to FIG. 7. While setup module 76 is illustrated as residing in memory 74 of installer interface device 13, setup module 76 is a software application that can be installed on any device capable of communicating and registering with control unit 16. For example, setup module 76 may be installed on user interface device 12.

Figure 8:
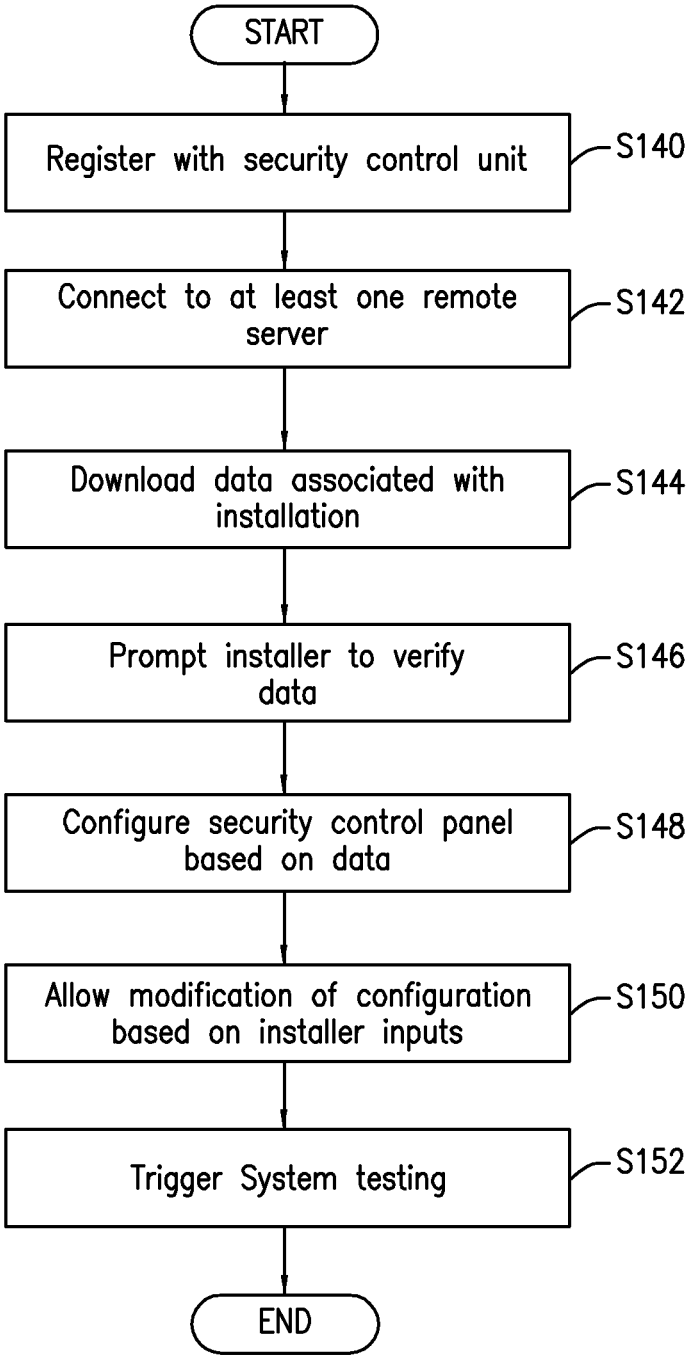
FIG. 8 is a flow chart of an example setup process of the invention in accordance with the principles of the invention.

An example setup process for configuring the premises based system such as control unit 16 is described with reference to FIG. 8. An installer or technician may enter an assigned, e.g., unique, installer code and associated password via interface 78 and also enters a code unique to the account being installed at control unit 16 in order to begin the setup process. The installer may be prompted to enter a unique identification and password in order to commence the setup process. The installer may have to enter a unique code into control unit 16 in order to ensure the installer is at premises. Processor 72 causes the installer interface device 13 to register with control unit 16 (Block S140). For example, installer interface device 13 may register with control unit 16 as an authenticated Wi-Fi client. In one embodiment, installer interface device 13 may communicate directly with control unit 16 without having to use network 18.

Processor 72 causes installer interface device 13 to establish communication with remote server 22 that includes configuration database 24 (Block S142). In an alternative embodiment, configuration database 24 may be located in network 18 or remote monitoring center 20 such that installer interface device 13 establishes communication with the entity that includes configuration database 24. Processor 72 cause data associated with the installation to be downloaded from server 22 or entity that includes configuration database 24 (Block S144). For example, processor 72 can request and receive system data associated with the installation in which system data includes account information, system configuration/parameters, quantities of devices 12 and 14 count, the location within the premises of premises device 14, communication configuration such as cell and/or broadband, life safety account information, life style account information and/or device layout/specifications, premises layout mapping, among other data related to system 10 configuration. In one embodiment, if the inventory of the security system being installed at the premises is known, remote server 22 can generate configuration data for at least one of control unit 16, user interface device 12 and premises device 14 for download to at least one of control unit 16, user interface device 12 and premises device 14.

Processor 72 may prompt the installer via interface 78 and/or display 80 to verify the received data (Block S146). For example, the installer may verify the correct number of premises devices 14 are to be installed and/or verify types of premises devices 14 to be installed, among other data associated with the premises based system to be installed. Further, the installer can modify the received data during or after the verification determination. Processor 72 configures the premises based system, e.g., security control panel 16, based at least in part on the downloaded and verified data (Block S148). For example, processor 72 activates security control panel 16 and upgrades security control panel 16 software or firmware if needed. Alternatively and/or in addition to automatic programming, interface 78 may allow the installer to manually program device 12 and/or 14. For example, the installer may select via interface 78 a desired programming option and required entry in which installer interface device 13 and/or control unit 16 may provide audible feedback each time a selection is made. Installer interface device 13 may display various configurations or options associated with desired programming option in which the installer will be able to select the desired configuration or option and then select the required entry. The enrollment and/or configuration of user interface device 12 and/or premises device 14 may be performed while control unit 16 is off-line such as when control unit 16 is not in communication with network 18 and/or remote monitoring center 20.

After activation and configuration, installer interface device 13 may display via interface 78 and/or display 80 an installer dashboard (FIG. 10) that lists a summary of the devices preconfigured based at least in part on the received data. Processor 72 allows modification of the configuration based at least in part on installer inputs via interface 78 (Block S150). For example, processor 72 can cause enrollment of user interface device 12 and premises device 14 due to an indication from an installer via interface 78 to enroll a particular device 12 and/or 14, i.e., installer selects an unenrolled device that was detected by control unit 16, and pushes the "enroll" button such that system 10 is automatically programmed.

Furthermore, the installer can modify device parameters by selecting device 12 or 14 and pressing an "edit" button. After allowing modification of control unit 16 and/or at least one premises device 14, processor 72 may trigger system 10 testing (Block S152). For example, an installer may select, via installer interface device 13 and/or control panel, specific premises devices 14 to test in which each premises device 14 will complete a test and display the result of the test. The specific test and testing parameters for each premises device 14 may be predefined by the premises providing company, manufacturer, security system provider and/or home automation provider. In one example, the test route verifies event signals from life safety premises devices 14 are received but does not trigger dispatch in response to the received event signals during testing. In one embodiment, control unit 16 and/or installer interface device 13 may upload to server 22 and/or remote monitoring center 20 the results of the test as proof of system operation. Therefore, the installer and security system company know the security system was properly installed and functioning at the time of installation.

Figure 9:
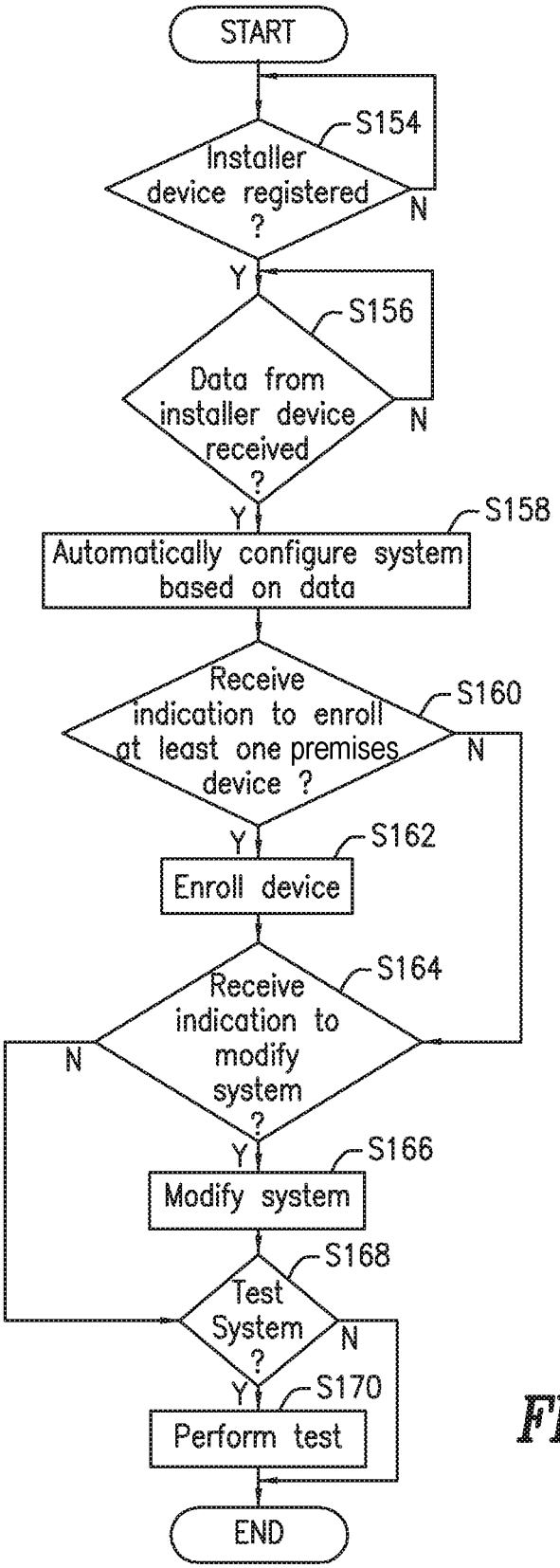
FIG. 9 is an example installation process of the invention in accordance with the principles of the invention.

An example installation process for configuring a premises based system such as control unit 16 is described with reference to FIG. 9. Processor 44 determines whether installer interface device 13 has registered with control unit 16 (Block S154). For example, processor 44 may authenticate installer interface device 13 to communicate and exchange data with control unit 16 in order to help ensure only authorized installers are able to modify the configuration of control unit 16 and/or at least one premises device 14 located at the premises. If processor 44 determines installer interface device 13 has not been registered, the determination of Block S154 may be repeated. Processor 44 may cause installer interface device 13 to prompt the installer to register device 13 with control unit 16.

If processor 44 determines installer interface device 13 has been registered, processor 44 determines whether data, e.g., system data, has been received from installer interface device 13 (Block S156). The data may include configuration data, location data and/or manufacturer data for at least one premises device 14, control unit 16 and/or user interface device 12, among other components of the security system to be installed at the premises. If processor 44 determines data has not been received from installer interface device 13, the determination of Block S156 is repeated. Alternatively, control unit 16 may be preconfigured based on prior sales data. In other words, control unit 16 may already have data stored in memory 46 prior to arrival at the premises, i.e., control unit 16 receives preconfigured data before the receipt of data from the installer interface device such that the automatic configuration of the security system is based at least in part on the received preconfigured data. If processor 44 determines data has been received, processor 44 automatically configures system 10 based at least in part on the received data (Block S158). For example, processor 44 uses the received data to automatically enroll and configure at least one premises device 14 and/or user interface device 12 with the control unit 16. Processor 44 may automatically configure at least one premises device 14 to function as another premises device 14 based at least in part on received data. For example, a life style device, i.e., premises device 14 that provides life style functionality, may be automatically configured to a life safety device, i.e., premises device 14 that provides life safety functionality.

Processor 44 determines whether an indication to enroll at least one premises device 14 and/or user interface device 12 has been received (Block S160). For example, the installer may indicate via interface 78 and/or via enrolled user interface device 12 that the installer wants to add another device 12 and/or 14. If an indication has been received to enroll at least one premises device, processor 44 enrolls the at least one indicated device 12 and/or 14 (Block S162).

Processor 44 determines whether an indication has been received to modify the configuration of system 10 (Block S164). For example, processor 44 may receive an indication from installer interface device 13 to modify a premises device 14 or sensor, i.e., modification of the security system may include at least one of adding a premises device, removing a premise device, modifying premises device settings and upgrading firmware. For example, the installer may indicate via installer interface device 13 that the installer wants to remove at least one user interface device 12 and/or premises device 14 from the automatically configured security system 10. In another example, the installer may indicate via installer interface device 13 that the installer wants to modify a characteristic of a user interface device 12, premises device 14 and/or security control panel 16. The characteristics may include firmware, detection settings and/or communication settings, among other characteristics of device 12, device 14 and/or unit 16.

If processor 44 determines an indication to modify system 10 has been received, processor 44 modifies system 10, i.e., device 12, device 14 and/or unit 16, based on the indication (Block S166). After modifying the at least one premises device 14, processor 44 determines whether an indication to test system has been received (Block S168). For example, an indication to test system may be received by processor 44 from installer interface device 13 and/or an enrolled user interface device 12. Testing may include at least one of determining a received signal strength at the at least one premises device fall within a predefined parameter range and determining at least one event signal from at least one life safety premises device is received.

If the determination is made to test system 10, processor 44 causes the premises based system to be tested via one or more predetermined test routines (Block S170). For example, processor 44 may test a front door sensor, i.e., premises device 14, according to a predefined door sensor test routine based an indication from installer interface device 13 to test the specific sensor. Referring back to Block S164, if the determination is made no indication to modify system 10 has been received, processor 44 performs the determination of Block S168. At Block S168, if processor 44 determines an indication has not been received to test system 10, processor 44 performs the determination of Block S160. The result of the test may be displayed to the installer via user interface device 12 and/or premises device 14.

Figure 10:
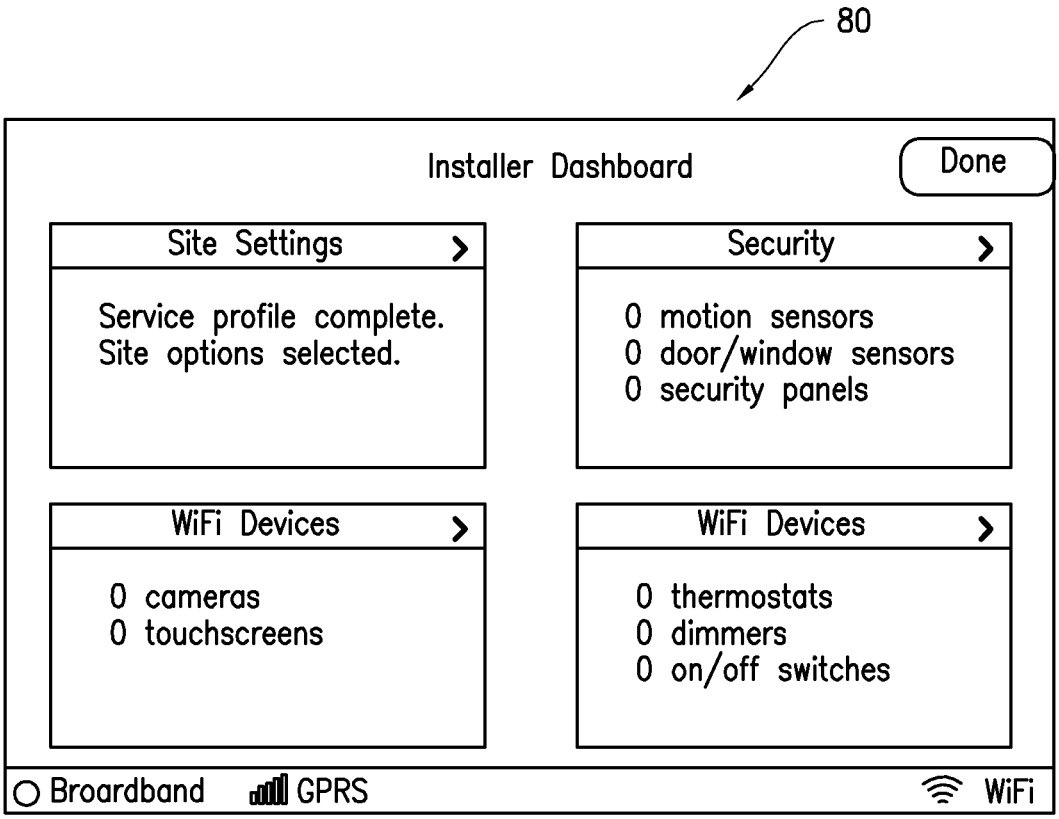
FIG. 10 is an example view of an installer dashboard screen of the invention in accordance with the principles of the invention.
Figure 11:
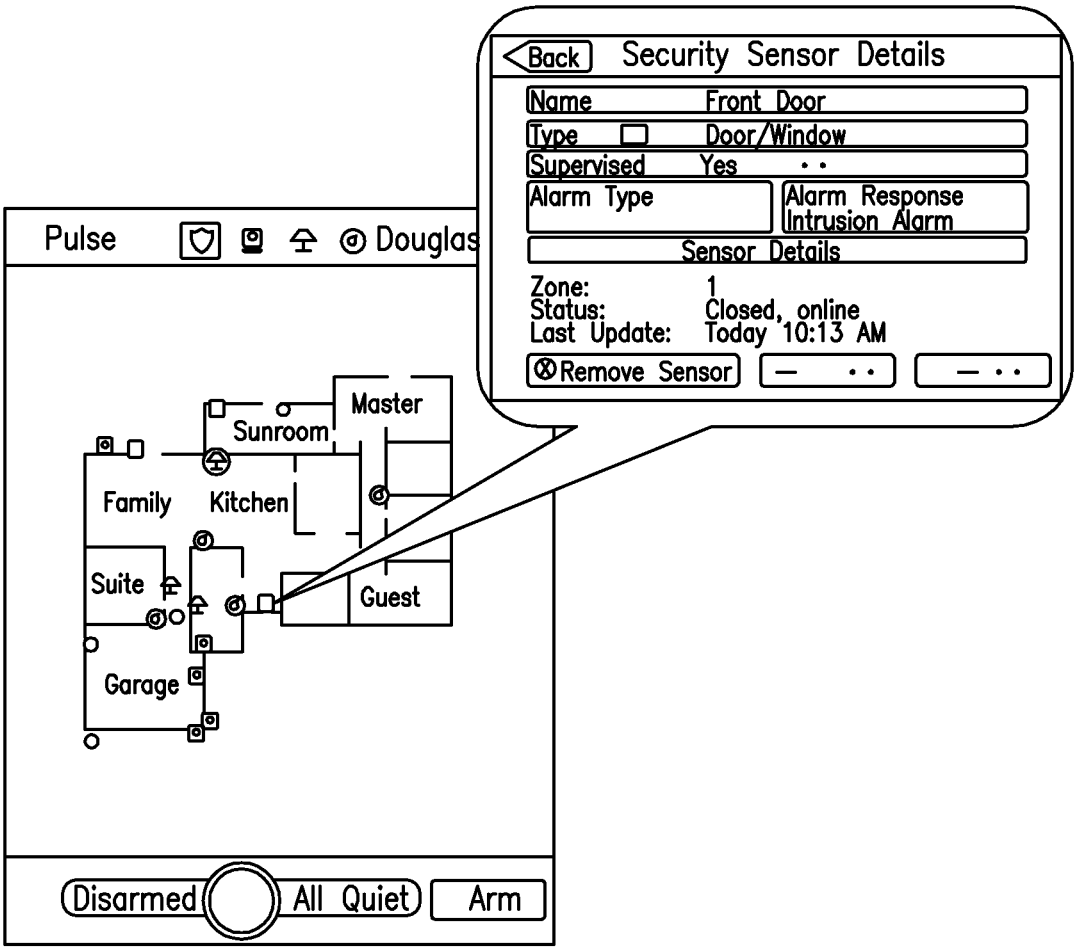
FIG. 11 is an example view of a device registration screen in accordance with the principles of the invention.

FIG. 10 is an example view of an installer dashboard screen in which a summary of devices enrolled in the premises based system are displayed. The installer dashboard allows the installer to visualize and confirm functionality of the components of premises based system, i.e., user interface device 12, premises device 14 and control unit 16 installed at the premises. FIG. 11 is an example view of a device registration screen displayed at least one of user interface device 12 and/or installer interface device 13. In example, an installer touches interface 78 and/or display 80, e.g., touchscreen display, to select premises device 14 in which installer can enroll premises device 14 by touching the "enroll" button on interface 78, i.e., provides an indication to enroll premises device 14 as described in Block S160. The device registration may be provides such as to allow the installer to edit or modify device 14 parameters and/or delete device 14. Whether device 14 was successful registered may be indicated in interface 78 by color coding, i.e., red indicates device 14 failed registration while green indicates device 14 is registered.

The invention can be realized in hardware, software, or a combination of hardware and software. Any kind of computing system, or other apparatus adapted for carrying out the methods described herein, is suited to perform the functions described herein. A typical combination of hardware and software could be a specialized or general purpose computer system having one or more processing elements and a computer program stored on a storage medium that, when loaded and executed, controls the computer system such that it carries out the methods described herein. The invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An apparatus for installation and testing of a system at a premises, the apparatus configured to communicate with an installer interface device, the apparatus comprising:

a communication subsystem that provides at least one communication protocol, the communication subsystem configured to receive data from the installer interface device and communicate with a plurality of premises devices; and a processor in communication with the communication subsystem, the processor configured to:

automatically configure at least one life safety feature of the system at a premises, the automatic configuration including at least configuring at least one life safety function of a plurality of premises devices to detect a premises condition that may result in life threatening harm to a person based at least in part on the received data, at least one of the plurality of premises devices that provides at least one life safety function being configured to change from providing a life style function to providing the at least one life safety function in response to the receiving of the data from the installer interface device; and test the configuration of at least one of the configured plurality of premises devices.

2. The apparatus of claim 1, wherein the communication subsystem is further configured to receive an indication from the installer interface device to configure at least one additional premises device; and the processor is further configured to configure the at least one additional premises device based at least in part on the indication from the installer interface device.

3. The apparatus of claim 1, wherein the at least one life safety feature is associated with a medical condition.

4. The apparatus of claim 1, wherein the data includes at least one of system parameters, device count, communications configuration, device type and device location within a premises layout mapping.

5. The apparatus of claim 1, wherein the communication subsystem is further configured to receive preconfigured system data before the receipt of the data from the installer interface device, the automatic configuration of the at least one life safety feature of the system being based at least in part on the received preconfigured system data.

6. The apparatus of claim 5, wherein modification of the system includes at least one of adding a premises device, removing a premises device, modifying premises device settings and upgrading firmware.

7. The apparatus of claim 1, wherein the testing includes at least one of determining whether a received signal of the at least one premises device falls within a predefined parameter range and determining whether at least one event signal from at least one life safety premises device is received.

8. The apparatus of claim 1, wherein the configured plurality of premises devices includes at least one of a life safety device and a lifestyle device; and the automatic configuration includes automatically configuring at least one life style feature of the system at a premises.

9. A method for installation and testing of a system at a premises, the system including a plurality of premises devices, the method comprising:

receiving data from an installer interface device;

communicating with the plurality of premises devices;

automatically configuring at least one life safety feature of the security system, the automatic configuration including at least configuring at least one life safety function of the plurality of premises devices to detect a premises condition that may result in life threatening harm to a person based at least in part on the received data, at least one of the plurality of premises devices that provides at least one life safety function being configured to change from providing a life style function to providing the at least one life safety function in response to the receiving of the data from the installer interface device; and testing the configuration of at least one of the configured plurality of premises devices.

10. The method of claim 9, further comprising receiving an indication from the installer interface device to configure at least one additional premises device; and configuring the at least one additional premises device based at least in part on the indication from the installer interface device.

11. The method of claim 9, wherein the automatic configuration includes automatically configuring at least one life style feature of the system at a premises.

12. The method of claim 9, wherein the data includes at least one of system parameters, device count, communications configuration, device type and device location within a premises layout mapping.

13. The method of claim 9, further comprising receiving preconfigured system data for configuring at least one premises device before receipt of the data from the installer interface device, the automatic configuration of the security system being based at least in part on the received preconfigured system data.

14. The method of claim 13, wherein modification of the system includes at least one of adding a premises device, removing a premises device, modifying premises device settings and upgrading firmware.

15. The method of claim 9, wherein the testing includes at least one of determining whether a received signal strength at the at least one premises device falls within a predefined parameter range and determining whether at least one event signal from at least one life safety premises device is received.

16. The method of claim 9, wherein the configured plurality of premises devices includes at least one of a life safety device and a lifestyle device, and the life safety device is configured to detect a medical emergency at the premises.

17. A system for configuration and testing of an arrangement at a premises, the arrangement including a plurality of premises devices, the system comprising:

an installer interface device, the installer interface device including:

a first processor, the first processor configured to:

download system data including configuration data for configuring the plurality of premises devices;

prompt a user of the installer interface device to verify the system data;

if the system data is verified by the user of the installer interface device, transmit the system data;

a control unit, the control unit including:

a communication subsystem that provides a plurality of communication protocols, the communication subsystem configured to receive the system data from the installer interface device and communicate with a plurality of premises devices; and a second processor, the second processor configured to:

automatically configure at least one life safety feature of the system at a premises, the automatic configuration including at least configuring at least one life safety function of a plurality of premises devices to detect a premises condition that may result in life threatening harm to a person based at least in part on the received system data, at least one of the plurality of premises devices that provides at least one life safety function being configured to change from providing a life style function to providing the at least one life safety function in response to the receiving of the system data from the installer interface device; and test the configuration of at least one of the configured plurality of premises devices.

18. The system of claim 17, wherein the communication subsystem of the control unit is further configured to receive an indication from the installer interface device to configure at least one additional premises device; and the second processor is further configured to configure the at least one additional premises device based at least in part on the indication from the installer interface device.

19. The system of claim 17, wherein the second processor is further configured to authenticate the installer interface device before automatically configuring the plurality of premises devices.

20. The system of claim 17, wherein the system data includes at least one of system parameters, device count, communications configuration, device type and device location within a security system layout mapping.

21. The system of claim 17, wherein the communication subsystem is further configured to receive preconfigured system data before the receipt of system data from the installer interface device.

22. The system of claim 21, wherein modification of the system includes at least one of adding a premises device, removing a premises device, modifying premises device settings and upgrading firmware.

23. The system of claim 17, wherein the testing includes at least one of determining whether a received signal strength at the at least one premises device falls within a predefined parameter range and determining whether at least one event signal from at least one life safety premises device is received.

24. The system of claim 17, wherein the configured plurality of premises devices includes at least one of a life safety device and a lifestyle device.

* * * * *